US010533294B2

(12) United States Patent
Nieters

(10) Patent No.: US 10,533,294 B2
(45) Date of Patent: Jan. 14, 2020

(54) SHOVEL HEAD WITH INTERLOCKING LEADING EDGE WEAR STRIP AND METHOD OF ATTACHING INTERLOCKING LEADING EDGE WEAR STRIP TO SHOVEL HEAD

(71) Applicant: Ryan Nieters, New Richmond, WI (US)

(72) Inventor: Ryan Nieters, New Richmond, WI (US)

(73) Assignee: Gizmo Tek LLC, New Richmond, WI (US)

( * ) Notice: Subject to any disclaimer, the term of this patent is extended or adjusted under 35 U.S.C. 154(b) by 0 days.

(21) Appl. No.: 16/396,747

(22) Filed: Apr. 28, 2019

(65) Prior Publication Data

US 2019/0330815 A1 Oct. 31, 2019

Related U.S. Application Data

(60) Provisional application No. 62/664,205, filed on Apr. 29, 2018.

(51) Int. Cl.
*E01H 5/02* (2006.01)

(52) U.S. Cl.
CPC ..... *E01H 5/02* (2013.01)

(58) Field of Classification Search
CPC ..... E01H 5/02; A01B 1/022
(Continued)

(56) References Cited

U.S. PATENT DOCUMENTS 107,314 A * 9/1870 Wentworth
111,939 A * 2/1871 Hubbard
(Continued)

*Primary Examiner* — Paul T Chin
(74) *Attorney, Agent, or Firm* — Ryan Nieters

(57) ABSTRACT

A shovel head, with a receptacle for a shaft, and a blade with two faces; a top face and a bottom face. The blade utilizes a separate, but interlocked, wear strip on the leading edge of the blade. The wear strip is similar in length to the length of the leading edge of the blade. The wear strip has a slot built into it, with an upper lip and a lower lip, and the slot runs parallel to the blade's leading edge and is of similar size in contrast to the blade thickness. There are two concave indentations internally, with one on the top lip of the slot, and one on the bottom lip of the slot, running parallel to, and the full length of the slot. On the faces of the blade there are two convex ribs, one rib on the top face, and one rib on the bottom face. The two ribs run parallel to the leading edge of the blade. The convex ribs on the blade's top and bottom face match in contrast to the concave indentations on the upper and lower lip of the wear strip slot in both size and shape. The wear strip is made of a material allowing some elasticity or spring back. The wear strip is applied to the leading edge of the blade by force; the leading edge of the blade aligns with the slot in the wear strip. As the leading edge of the blade moves further into the slot of the wear strip, and with the elasticity of the wear strip material, the convex ribs on the blade faces begin to spread the upper and lower lips of the slot in the wear strip wider as the wear strip passes over them. With continued force the wear strip is applied further onto the leading edge of the blade until the convex ribs on the blade faces and the concave indentations in the wear strip slot align with each other. The wear strip upper and lower lips snap back to form their original shape over the ribs, thus interlocking and attaching the wear strip to the leading edge of the blade on the shovel head.

4 Claims, 6 Drawing Sheets

(58) Field of Classification Search
USPC ..... 294/49, 51, 54.5, 56, 59; 172/372, 375, 172/381
See application file for complete search history.

(56) References Cited

U.S. PATENT DOCUMENTS

| | | | | | |
|---|---|---|---|---|---|
| 366,099 | A * | 7/1887 | Hinchman | | |
| 1,062,474 | A * | 5/1913 | Kelly | E01H 5/02 | 294/54.5 |
| 1,176,112 | A * | 3/1916 | Volkstadt | E01H 5/02 | 294/54.5 |
| 1,393,688 | A * | 10/1921 | Johnson | A43B 13/38 | 36/22 R |
| 1,401,432 | A * | 12/1921 | Nordquist | A01B 15/06 | 172/749 |
| 4,911,249 | A * | 3/1990 | Mitchell | A01B 15/02 | 172/719 |
| 6,497,439 | B1 * | 12/2002 | Guo | E01H 5/02 | 294/54.5 |
| 9,526,196 | B2 * | 12/2016 | Park | A01B 1/02 | |
| 2003/0025344 | A1 * | 2/2003 | Schultice | E01H 5/02 | 294/54.5 |

* cited by examiner

SHOVEL HEAD WITH INTERLOCKING LEADING EDGE WEAR STRIP AND METHOD OF ATTACHING INTERLOCKING LEADING EDGE WEAR STRIP TO SHOVEL HEAD

FIELD OF INVENTION

This invention relates to hand implements, more specifically to shovel heads, and their leading edge wear strip components.

BACKGROUND OF INVENTION

The shovel has been and continues to be used as a common tool for a large variety of tasks, and the movement of many different materials. Removal of snow from passages, driveways, and pathways as one example of a shovels use. It is an important hand implement for many people in their personal and professional lives.

Shovels in most cases, incorporate a scoop or blade shape. In some cases they incorporate a permanently, or semi-permanently mounted wear strip at the leading edge of the shovel blade. With shovels that incorporate a wear strip, often times the wear strip is made of metal.

It is desirable in the manufacturing and assembly of a shovel that incorporates a wear strip, that the addition of the wear strip be easy to accomplish, efficient, and not require special tools or special processes.

It is also desirable that as the wear strip on a shovel begins to degrade with use, abrasion, and corrosion, that it can be replaced by the user, and therefore extend the useful life of the shovel.

It is also desirable that the wear strip on a shovel could be made of a variety of materials, a material to fit the intended application of the shovel, in some cases a material that prevents damage when used on vulnerable surfaces, and in all cases still replaceable by the user.

To overcome the problems associated with permanently and semi-permanently mounted wear strips, an easy to install and remove wear strip is needed; and the ability for the user to extend the useful life of a shovel that incorporates a wear strip is needed.

SUMMARY OF INVENTION

The present invention describes a leading edge wear strip used on the blade of a shovel head, and a method for attaching this wear strip to the leading edge of the blade.

A specific object of this invention is to provide a wear strip incorporating a slot with concave internal indentations, and the interlocking of the wear strip to the leading edge on the blade of a shovel head, where the blade top and bottom faces have matching convex external ribs.

Another object is to simplify the installation of the wear strip onto the leading edge of the shovel head blade during manufacturing, eliminating the need for special processing, and additional tooling or fasteners.

Another objective is to provide a wear strip that can be replaced by the user, as often as desired, extending the useful life of the shovel.

Another objective is to provide a wear strip that can be made of a material to fit the intended application, but is still replaceable.

Other objectives and advantages of this invention will become apparent from the following description, taken in conjunction with the accompanying drawings, by way of illustration and example. The drawings are a part of the specification and include model embodiments of the present invention, and illustrate various objects and features of the invention.

BRIEF DESCRIPTION OF THE IMAGES

DETAILED DESCRIPTION OF THE INVENTION

This invention has been described in terms of a specified embodiment, it will be apparent to those skilled in this particular art that a variety of modifications, rearrangements, and substitutions could be made without departing from the intended spirit of the invention. The present disclosure is to be considered an exemplification of this invention and is not intended to limit the invention to the specific embodiments illustrated. The scope of this invention is defined by the claims attached within.

This invention describes a component as it relates to a hand implement, more specifically a shovel head. The shovel head utilizing a separate interlocked component; a wear strip on the leading edge of the shovel head blade.

Figure 1:
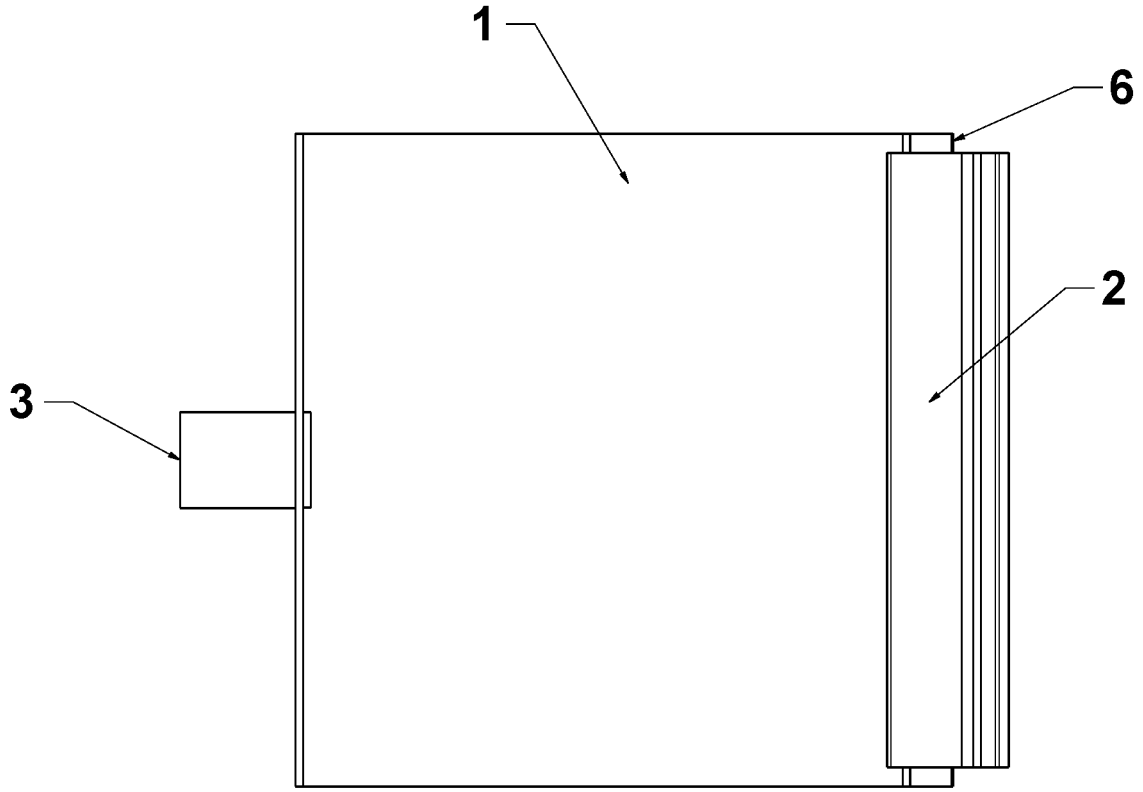
FIG. 1 is a top view of a shovel head with the interlocking wear strip installed.

Referring to FIG. 1, shown is a top view of a shovel head including the blade 1, the shaft receptacle 3, and the interlocking wear strip 2 shown installed on the leading edge 6 of the blade 1. The blade 1 of a shovel head can be made out of a variety of different materials based on the intended application of the shovel, one option for a material is HDPE (High Density Polyethylene), and a common method of manufacturing is plastic injection molding. The interlocking wear strip 2 can be made out of a variety of different materials, the material used would need to have certain properties to be effective, such as durability, and some elasticity or spring back to aid in assembly; polypropylene is one option for material and a common method of manufacturing is extruding.

Figure 2:
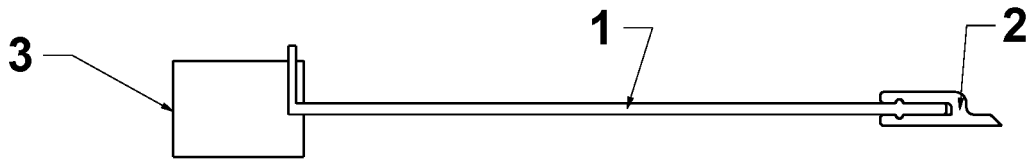
FIG. 2 is a side view of a shovel head as in FIG. 1 with the interlocking wear strip installed.

Referring to FIG. 2, shown is a side view of the shovel head as in FIG. 1.

Figure 3:
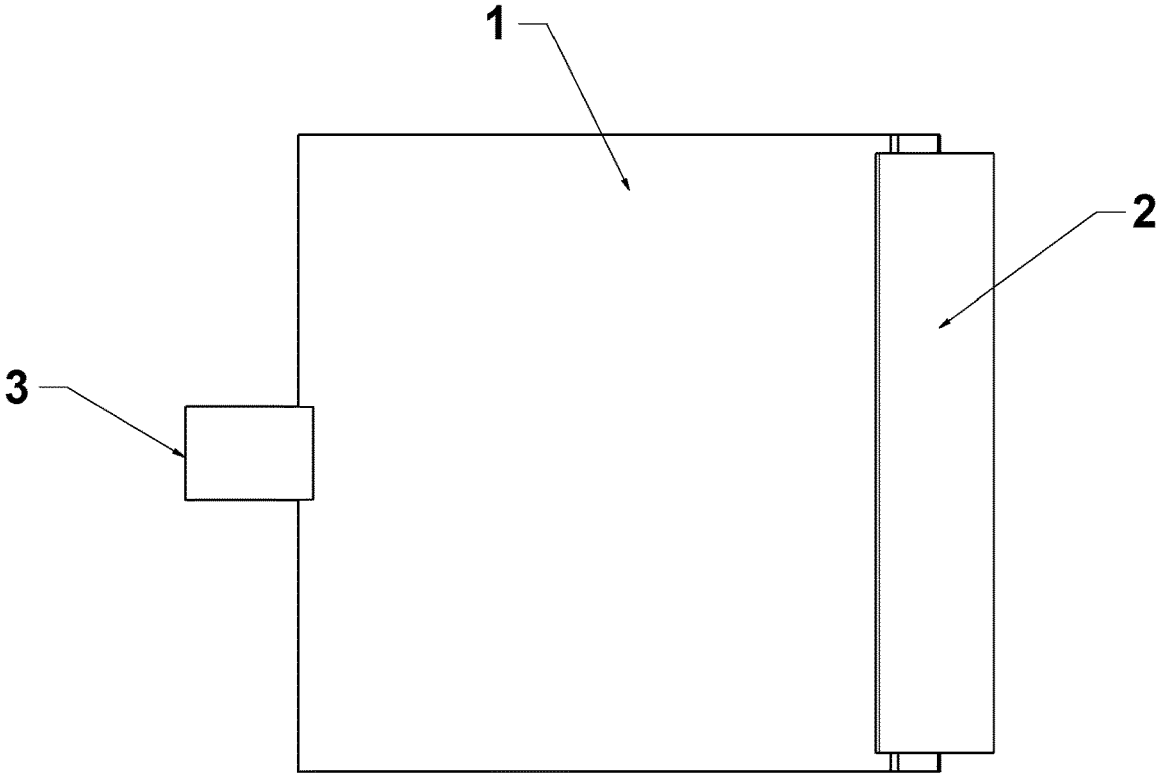
FIG. 3 is a bottom view of a shovel head as in FIG. 1 with the interlocking wear strip installed.

Referring to FIG. 3, shown is a bottom view of the shovel head as in FIG. 1.

Figure 4:
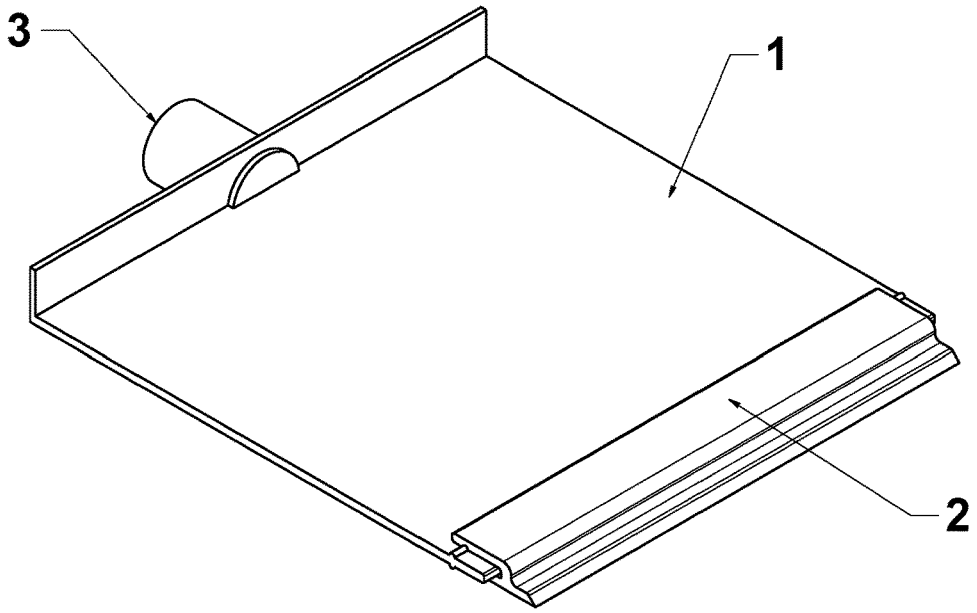
FIG. 4 is a perspective view of a shovel head as in FIG. 1 with the interlocking wear strip installed.

Referring to FIG. 4, shown is a perspective view of the shovel head as in FIG. 1.

Figure 5:
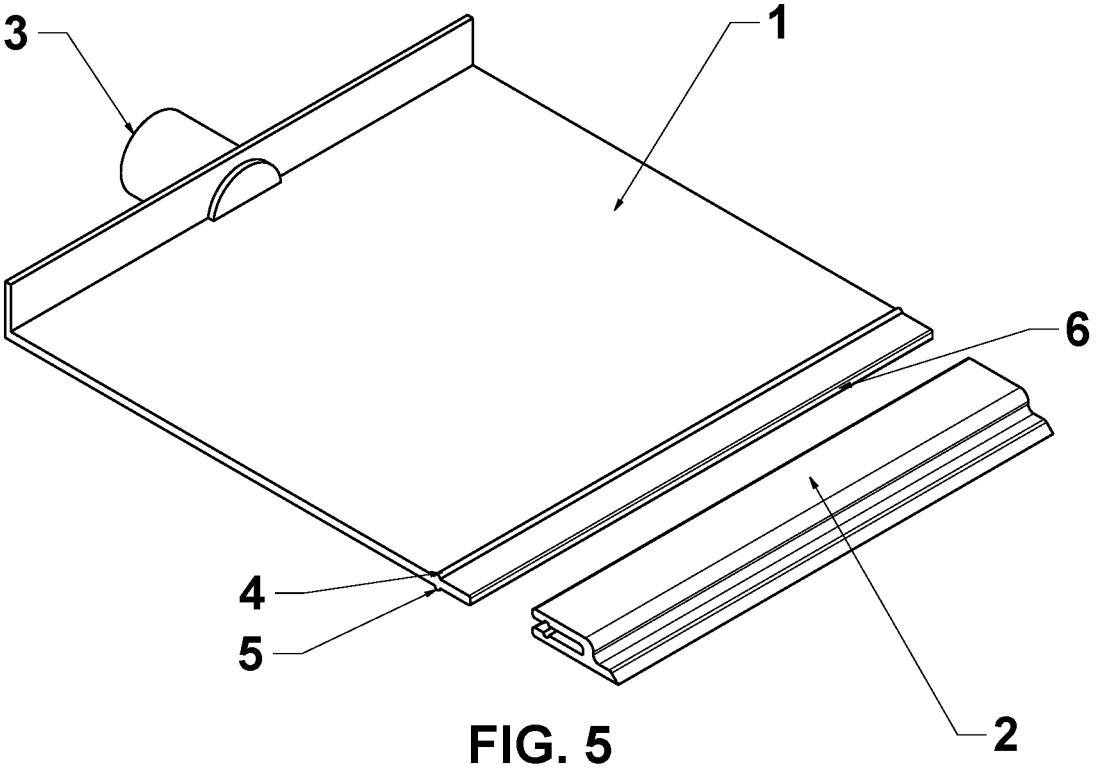
FIG. 5 is a perspective view of a shovel head as in FIG. 1 with interlocking wear strip shown prior to installation.

Referring to FIG. 5, shown is a perspective view of the shovel head similar to FIG. 4, but with the interlocking wear strip 2 removed from the blade 1. During the making of the blade 1, the convex rib 4 is built onto the top face of the blade 1, and the convex rib 5 is built onto the bottom face of the blade 1, both convex ribs 4 and 5 are built at a specified distance from the leading edge 6 of the blade 1.

Figure 6:
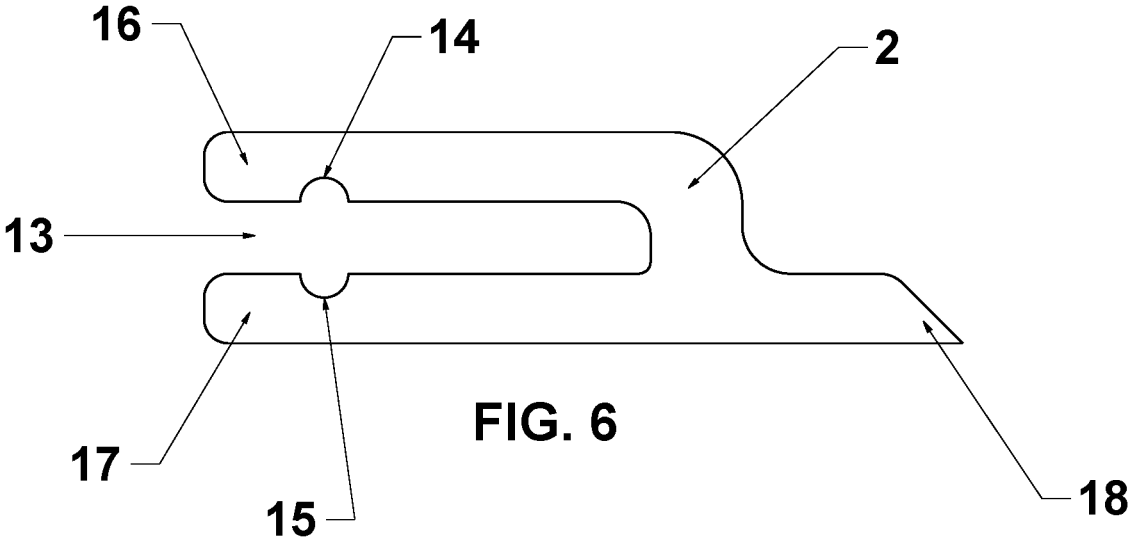
FIG. 6 is an enlarged side view of an interlocking wear strip showing the general shape.

Referring to FIG. 6, shown is an enlarged side view of the wear strip 2 as in FIG. 5 with the blade 1 omitted. This shows more detail and a general shape of the wear strip 2. The main body of the interlocking wear strip 2 is made up of an upper lip 16, a lower lip 17, and a slot 13 of a specified size between the upper lip 16 and lower lip 17. Inside the slot there are two concave indentations 14 and 15, the upper concave indentation 14 is on the bottom side of the upper lip 16, and the lower concave indentation 15 in on the top side of the lower lip 17. Both concave indentations 14 and 15 are built at a specified location inside the slot 13, and run the entire length of the slot 13. The leading edge 18 of the interlocking wear strip 2 is the sacrificial material which wears away over time from use of the shovel on abrasive surfaces.

Figure 7:
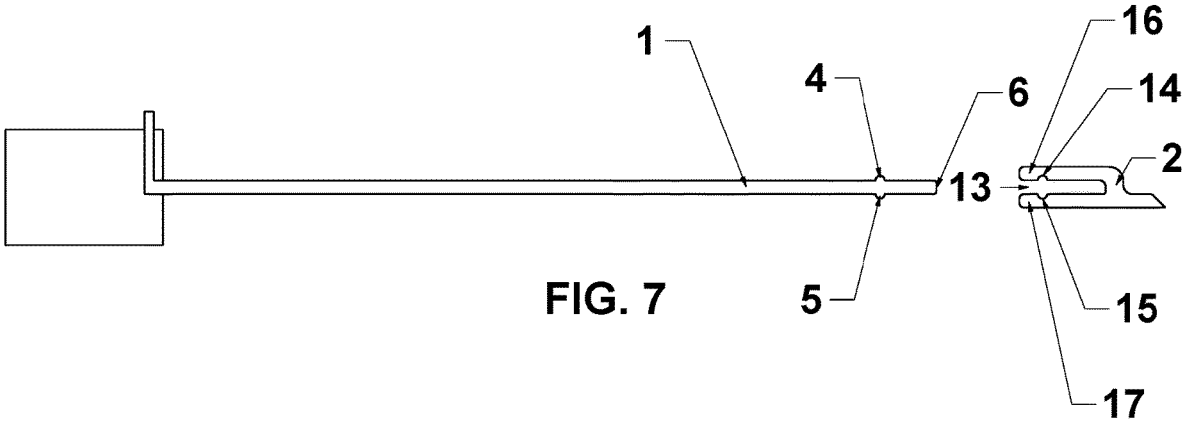
FIG. 7 is an enlarged side view of a shovel head as in FIG. 5 with an interlocking wear strip shown prior to installation on the blade.

Referring to FIG. 7, shown is a side view of the shovel head as in FIG. 5 with the interlocking wear strip 2 in a position ready to be installed onto the leading edge 6 of the blade 1. The slot 13 in the interlocking wear strip 2, is of a similar size to the thickness of the leading edge 6 of the blade 1. The internal concave indentations 14 and 15 on the upper lip 16 and lower lip 17 of the slot 13 are made to match in contrast to the convex ribs 4 and 5 in both size and shape. The concave indentations 14 and 15 are made in a specified location within the slot 13 so they will interlock with the convex ribs 4 and 5 when the interlocking wear strip 2 is fully installed on the leading edge 6 of the blade 1.

Figure 8:
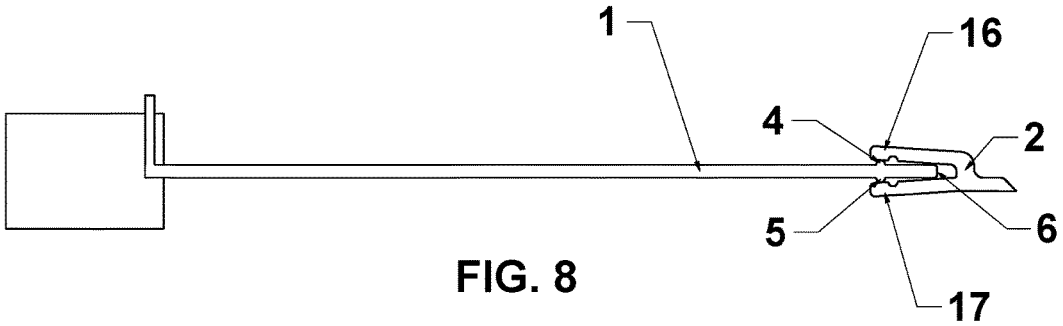
FIG. 8 is an enlarged side view of a shovel head similar to FIG. 6 with the interlocking wear strip shown during installation onto the blade.

Referring to FIG. 8, shown is a view similar to FIG. 7 but with the interlocking wear edge 2 partially installed onto the leading edge 6 of the blade 1 by pressure being applied to the wear strip 2 from right to left. As the upper lip 16 and lower lip 17 of the interlocking wear strip 2 begin to contact the convex ribs 4 and 5 of the blade 1, the elasticity of the interlocking wear strip 2 allows the interlocking wear strip 2 upper and lower lips 16 and 17 to widen further as continued pressure is applied to the interlocking wear strip 2 from right to left.

Figure 9:
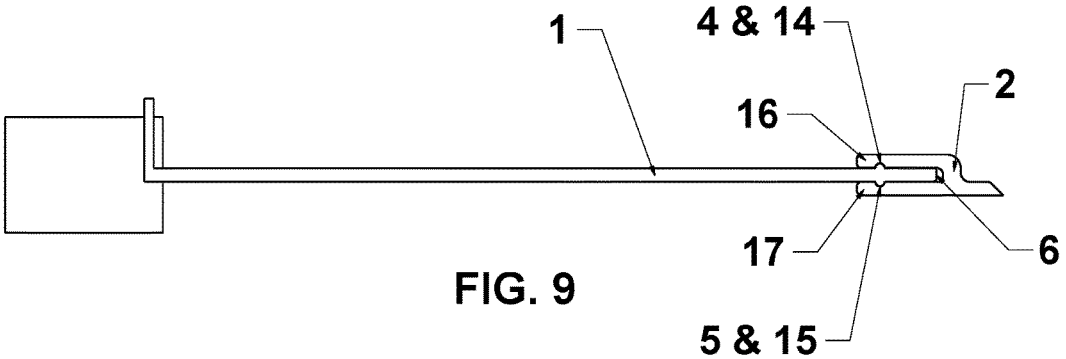
FIG. 9 is an enlarged side view of a shovel head as in FIG. 4 with the interlocking wear strip shown after installation on the blade.

Referring to FIG. 9, shown is view similar to FIG. 7 and FIG. 8, but with the completed installation of the interlocking wear strip 2 on to the leading edge 6 of the blade 1 as started in FIG. 8. The elasticity of the interlocking wear strip 2 allows for the upper and lower lips 16 and 17 of the slot 13 to snap back to form their original shape as shown in FIG. 7. When the convex ribs 4 and 5 and internal concave indentations 14 and 15 are lined up in full installation, the convex ribs 4 and 5 and the internal concave indentations 14 and 15 interlock the wear strip 2 onto the leading edge 6 of the blade 1. Using two simple hand tools, such as flat blade screw drivers, the interlocking wear strip 2 can be removed from the leading edge 6 of the blade 1 as shown in FIG. 8 with the interlocking wear strip 2 now moving from left to right for removal. This allows the user to remove and replace the interlocking wear strip 2 as often as needed to extend the useful life of the shovel.

Figure 10:
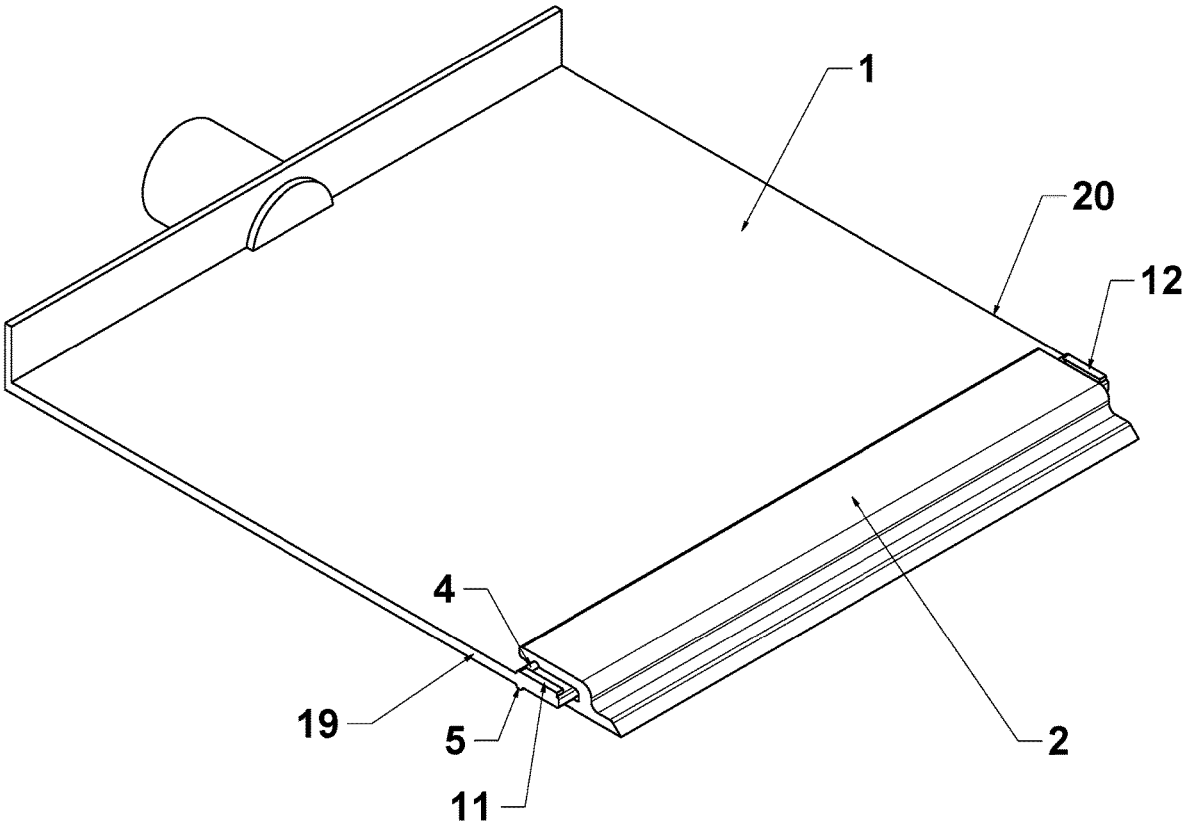
FIG. 10 is a perspective view of a shovel head similar to FIG. 4 including two optional convex containment ribs.

Referring to FIG. 10, shown is a perspective view similar to FIG. 4. In order to contain the interlocking wear strip 2 from sliding off the side of the blade 1, two additional ribs 11 and 12 can be built on the top face of the blade 1. These additional ribs 11 and 12 are made at the outer sides 19 and 20 of the blade 1, and are made perpendicular to the convex ribs 4 and 5. These additional ribs 11 and 12 cause an interference with the interlocking wear strip 2 if pressure were applied to either side of the interlocking wear strip 2 maintaining its position on the blade 1.

Figure 11:
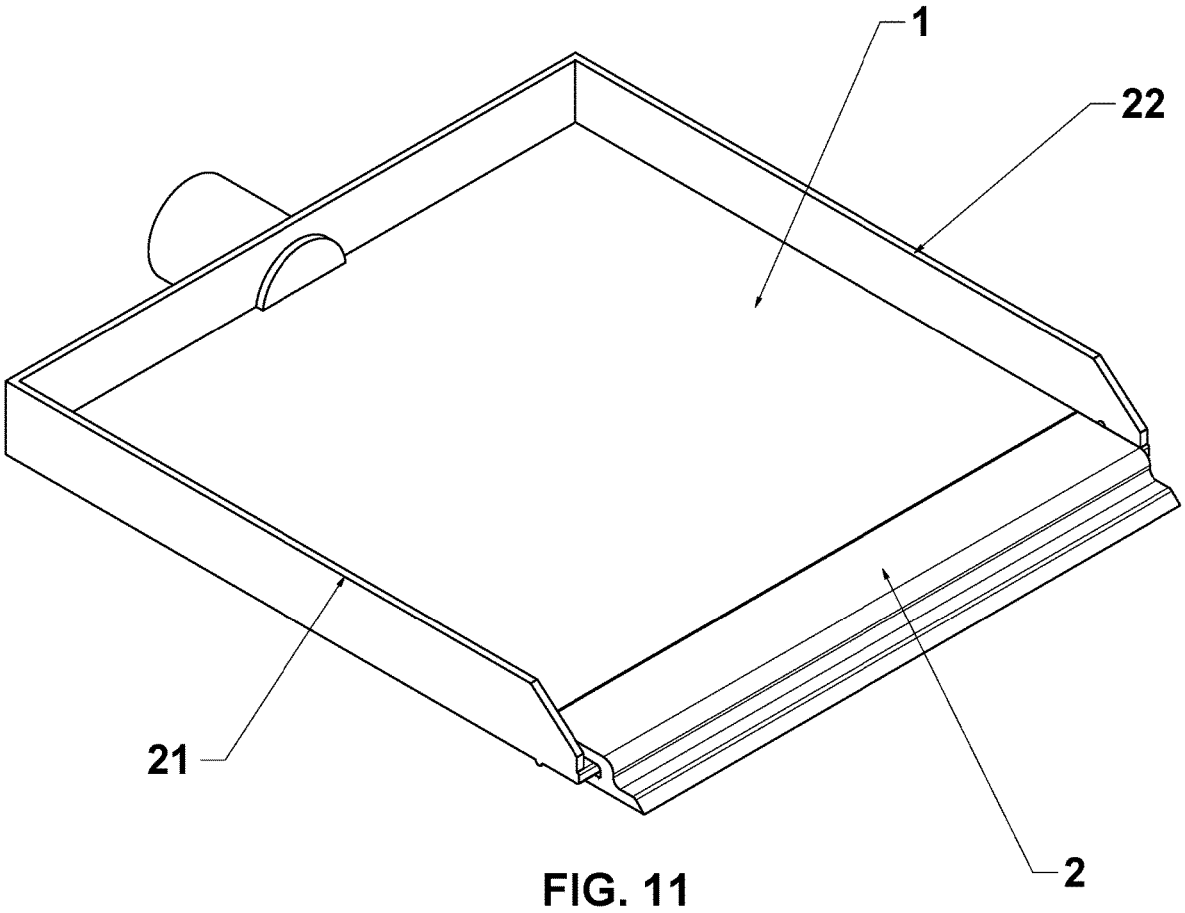
FIG. 11 is a perspective view of a shovel head similar to FIG. 4 including two side walls built on the shovel blade for containment.

Referring to FIG. 11, shown is a perspective view similar to FIG. 10. In order to contain the interlocking wear strip 2 from sliding off the side of the blade 1, two additional side walls 21 and 22 can be built on the top face of the blade 1. These additional side walls 21 and 22 are made at the outer sides 19 and 20 of the blade 1, and run to the leading edge 6 of the blade 1. These additional side walls 21 and 22 cause an interference with the interlocking wear strip 2 if pressure were applied to the side of the interlocking wear strip 2 maintaining its position on the blade 1.

What is claimed is:

1. A shovel head comprising:

a. a receptacle on said shovel head for receiving a shaft;

b. a blade comprising:

i. a top face;

ii. a bottom face;

iii. a leading edge opposite of said receptacle;

iv. an upper convex rib on said top face running parallel to said leading edge and at a specified distance from said leading edge;

v. a lower convex rib on said bottom face running parallel to said leading edge and at a specified distance from said leading edge;

c. an interlocking wear strip on said leading edge of said blade comprising:

i. a main body of a specified length similar in length to said leading edge;

ii. a slot in said main body of a specified size similar to the distance between said top face and said bottom face with an upper lip and a lower lip;

iii. an upper concave indentation on the bottom side of said upper lip running parallel to said main body of a similar size and shape to said upper convex rib along the entire length of said slot;

iv. a lower concave indentation on the top side of said lower lip running parallel to said main body of a similar size and shape to said lower convex rib along the entire length of said slot;

v. and a sacrificial material as part of said main body.

2. The shovel head in claim 1 in which two additional ribs on said top face running perpendicular to said upper convex rib and intersecting with said upper convex rib at the outer edges of said blade that run perpendicular to said leading edge.

3. The shovel head in claim 1 in which the addition of two side walls on said top face running perpendicular to said upper convex rib and intersecting with said upper convex rib at the outer edges of said blade that run perpendicular to said leading edge.

4. A method of attaching an interlocking wear strip to the leading edge portion of a shovel blade thereof comprising the steps of:

a. providing an elongated slot of a specified size in said wear strip with an upper internal concave indentation on the upper lip of said slot and a lower internal concave indentation on the lower lip of said slot running parallel to said slot and the full length of said slot in a specified size and shape and location;

b. providing an external upper convex rib on the upper face of said shovel blade and a lower convex rib on the lower face of said shovel blade at a specified distance from said leading edge running parallel to said leading edge at a specified length;

c. placing said wear strip with said slot lined up with said leading edge onto said shovel blade until the said upper convex rib and said lower convex rib make contact with the said upper lip and said lower lip of said slot;

d. applying pressure on said wear strip so said upper lip and said lower lip begin to travel over said upper convex rib and said lower convex rib widening said slot;

e. continue applying said pressure on said wear strip until said upper convex rib and said lower convex rib align with said upper concave indentation and said lower concave indentation allowing said upper lip and said lower lip to return to their original shape with the narrowing of said slot.

* * * * *